US008409496B2

(12) United States Patent
Pandey

(10) Patent No.: US 8,409,496 B2
(45) Date of Patent: Apr. 2, 2013

(54) SUPERPLASTIC FORMING HIGH STRENGTH $L1_2$ ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 770 days.

(21) Appl. No.: 12/558,833

(22) Filed: Sep. 14, 2009

(65) Prior Publication Data

US 2011/0061494 A1 Mar. 17, 2011

(51) Int. Cl.
*B22F 3/14* (2006.01)
*B22F 3/24* (2006.01)
*C22C 1/04* (2006.01)

(52) U.S. Cl. ..... 419/28; 419/23; 419/60

(58) Field of Classification Search ..... 419/28, 419/29, 48, 23
See application file for complete search history.

(56) References Cited

U.S. PATENT DOCUMENTS

| | | | |
|---|---|---|---|
| 3,619,181 | A | 11/1971 | Willey et al. |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | La Caer et al. |
| 4,713,216 | A | 12/1987 | Higashi et al. |
| 4,755,221 | A | 7/1988 | Paliwal et al. |
| 4,832,741 | A | 5/1989 | Couper |
| 4,834,810 | A | 5/1989 | Benn et al. |
| 4,834,942 | A | 5/1989 | Frazier et al. |
| 4,853,178 | A | 8/1989 | Oslin |
| 4,865,806 | A | 9/1989 | Skibo et al. |
| 4,874,440 | A | 10/1989 | Sawtell et al. |
| 4,915,605 | A | 4/1990 | Chan et al. |
| 4,923,532 | A | 5/1990 | Zedalis et al. |
| 4,927,470 | A | 5/1990 | Cho |
| 4,933,140 | A | 6/1990 | Oslin |
| 4,946,517 | A | 8/1990 | Cho |
| 4,964,927 | A | 10/1990 | Shiflet et al. |
| 4,988,464 | A | 1/1991 | Riley |
| 5,032,352 | A | 7/1991 | Meeks et al. |
| 5,053,084 | A | 10/1991 | Masumoto et al. |
| 5,055,257 | A | 10/1991 | Chakarabari et al. |
| 5,059,390 | A | 10/1991 | Burleigh et al. |
| 5,066,342 | A | 11/1991 | Rioja et al. |
| 5,076,340 | A | 12/1991 | Bruski et al. |
| 5,076,865 | A | 12/1991 | Hashimoto et al. |
| 5,130,209 | A | 7/1992 | Das et al. |
| 5,133,931 | A | 7/1992 | Cho |
| 5,198,045 | A | 3/1993 | Cho et al. |
| 5,211,910 | A | 5/1993 | Pickens et al. |
| 5,226,983 | A | 7/1993 | Skinner et al. |
| 5,256,215 | A | 10/1993 | Horimura |
| 5,308,410 | A | 5/1994 | Horimura et al. |
| 5,312,494 | A | 5/1994 | Horimura et al. |
| 5,318,641 | A | 6/1994 | Masumoto et al. |
| 5,397,403 | A | 3/1995 | Horimura et al. |
| 5,458,700 | A | 10/1995 | Masumoto et al. |
| 5,462,712 | A | 10/1995 | Langan et al. |
| 5,480,470 | A | 1/1996 | Miller et al. |
| 5,532,069 | A | 7/1996 | Masumoto et al. |
| 5,597,529 | A | 1/1997 | Tack |
| 5,620,652 | A | 4/1997 | Tack et al. |
| 5,624,632 | A | 4/1997 | Baumann et al. |
| 5,882,449 | A | 3/1999 | Waldron et al. |
| 6,139,653 | A | 10/2000 | Fernandes et al. |
| 6,149,737 | A | 11/2000 | Hattori et al. |
| 6,248,453 | B1 | 6/2001 | Watson |
| 6,254,704 | B1 | 7/2001 | Laul et al. |
| 6,258,318 | B1 | 7/2001 | Lenczowski et al. |
| 6,309,594 | B1 | 10/2001 | Meeks, III et al. |
| 6,312,643 | B1 | 11/2001 | Upadhya et al. |
| 6,315,948 | B1 | 11/2001 | Lenczowski et al. |
| 6,331,218 | B1 | 12/2001 | Inoue et al. |
| 6,355,209 | B1 | 3/2002 | Dilmore et al. |
| 6,368,427 | B1 | 4/2002 | Sigworth |
| 6,506,503 | B1 | 1/2003 | Mergen et al. |
| 6,517,954 | B1 | 2/2003 | Mergen et al. |
| 6,524,410 | B1 | 2/2003 | Kramer et al. |
| 6,531,004 | B1 | 3/2003 | Lenczowski et al. |
| 6,562,154 | B1 | 5/2003 | Rioja et al. |
| 6,630,008 | B1 | 10/2003 | Meeks, III et al. |
| 6,702,982 | B1 | 3/2004 | Chin et al. |
| 6,902,699 | B2 | 6/2005 | Fritzemeier et al. |
| 6,918,970 | B2 | 7/2005 | Lee et al. |
| 6,974,510 | B2 | 12/2005 | Watson |
| 7,048,815 | B2 | 5/2006 | Senkov et al. |
| 7,097,807 | B1 | 8/2006 | Meeks, III et al. |
| 7,241,328 | B2 | 7/2007 | Keener |
| 7,344,675 | B2 | 3/2008 | Van Daam et al. |

(Continued)

FOREIGN PATENT DOCUMENTS

| | | | |
|---|---|---|---|
| CN | 1436870 | A | 8/2003 |
| CN | 101205578 | A | 6/2008 |

(Continued)

OTHER PUBLICATIONS

Cabbibo, M. et al., "A TEM study of the combined effect of severe plastic deformation and (Zr), (Sc+Zr)-containing dispersoids on an Al-Mg-Si alloy." Journal of Materials Science, vol. 41, Nol. 16, Jun. 6, 2006. pp. 5329-5338.

Litynska-Dobrzynska, L. "Effect of heat treatment on the sequence of phases formation in Al-Mg-Si alloy with Sc and Zr additions." Archives of Metallurgy and Materials. 51 (4), pp. 555-560, 2006.

(Continued)

*Primary Examiner* — Roy King
*Assistant Examiner* — Ngoclan T Mai
(74) *Attorney, Agent, or Firm* — Kinney & Lange, P.A.

(57) ABSTRACT

A method and apparatus produces high strength aluminum alloys from a powder containing $L1_2$ intermetallic dispersoids. The powder is degassed, sealed under vacuum in a container, consolidated by vacuum hot pressing, and superplastically formed into a usable part.

9 Claims, 13 Drawing Sheets

U.S. PATENT DOCUMENTS

| | | | |
|---|---|---|---|
| 2001/0054247 | A1 | 12/2001 | Stall et al. |
| 2003/0192627 | A1 | 10/2003 | Lee et al. |
| 2004/0046402 | A1 | 3/2004 | Winardi |
| 2004/0055671 | A1 | 3/2004 | Olson et al. |
| 2004/0089382 | A1 | 5/2004 | Senkov et al. |
| 2004/0170522 | A1 | 9/2004 | Watson |
| 2004/0191111 | A1 | 9/2004 | Nie et al. |
| 2005/0013725 | A1 | 1/2005 | Hsiao |
| 2005/0147520 | A1 | 7/2005 | Canzona |
| 2006/0011272 | A1 | 1/2006 | Lin et al. |
| 2006/0093512 | A1 | 5/2006 | Pandey |
| 2006/0172073 | A1 | 8/2006 | Groza et al. |
| 2006/0269437 | A1 | 11/2006 | Pandey |
| 2007/0048167 | A1 | 3/2007 | Yano |
| 2007/0062669 | A1 | 3/2007 | Song et al. |
| 2008/0066833 | A1 | 3/2008 | Lin et al. |

FOREIGN PATENT DOCUMENTS

| | | | |
|---|---|---|---|
| EP | 0 208 631 | A1 | 6/1986 |
| EP | 0 584 596 | A2 | 3/1994 |
| EP | 1 111 079 | A1 | 6/2001 |
| EP | 1 249 303 | A1 | 10/2002 |
| EP | 1 170 394 | B1 | 4/2004 |
| EP | 1 439 239 | A1 | 7/2004 |
| EP | 1 471 157 | A1 | 10/2004 |
| EP | 1 111 078 | B1 | 9/2006 |
| EP | 1 728 881 | A2 | 12/2006 |
| EP | 1 788 102 | A1 | 5/2007 |
| EP | 2110452 | A1 | 10/2009 |
| FR | 2 656 629 | A1 | 12/1990 |
| FR | 2843754 | A1 | 2/2004 |
| JP | 04218638 | A | 8/1992 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2006248372 | A | 9/2006 |
| JP | 2007188878 | A | 7/2007 |
| KR | 20040067608 | A | 7/2004 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | 9111540 | A1 | 8/1991 |
| WO | 9532074 | A2 | 11/1995 |
| WO | WO9610099 | | 4/1996 |
| WO | 9833947 | A1 | 8/1998 |
| WO | 00 37696 | A1 | 6/2000 |
| WO | 0112868 | A1 | 2/2001 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 5/2004 |
| WO | 2005 045080 | A1 | 5/2005 |
| WO | 2005047554 | A1 | 5/2005 |

OTHER PUBLICATIONS

Litynska-Dobrzynska, L. "Precipitation of Phases in Al-Mg-Si-Cu Alloy with Sc and Zr and Zr Additions During Heat Treatment" Diffusion and Defect Data, Solid State Data, Part B, Solid Statephenomena. vol. 130, No. Applied Crystallography, Jan. 1, 2007. pp. 163-166.

Cook, R., et al. "Aluminum and Aluminum Alloy Powders for P/M Applications." The Aluminum Powder Company Limited, Ceracon Inc., Jan. 2007.

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of Al88RE8Ni4 amorphous alloys." Philosophical Magazine A, 2000, vol. 80, No. 5, pp. 1193-1206.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of Al3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Riddle, Y.W., et al. "A Study of Coarsening, Recrystallization, and Morphology of Microstructure in Al-Sc-(Zr)-(Mg) Alloys." Metallurgical and Materials Transactions A. vol. 35A, Jan. 2004. pp. 341-350.

Mil'Man, Y.V. et al. "Effect of Additional Alloying with Transition Metals on the STructure of an Ai-7.1 Zn-1.3 Mg-0.12 Zr Alloy." Metallofizika I Noveishie Teknohologii, 26 (10), 1363-1378, 2004.

Tian, N. et al. "Heating rate dependence of glass transition and primary crystallization of Al88Gd6Er2Ni4 metallic glass." Scripta Materialia 53 (2005) pp. 681-685.

Litynska, L. et al. "Experimental and theoretical characterization of Al3Sc precipitates in Al-Mg-Si-Cu-Sc-Zr alloys." Zeitschrift Fur Metallkunde. vol. 97, No. 3. Jan. 1, 2006. pp. 321-324.

Rachek, O.P. "X-ray diffraction study of amorphous alloys Al-Ni-Ce-Sc with using Ehrenfest's formula." Journal of Non-Crystalline Solids 352 (2006) pp. 3781-3786.

Pandey A B et al, "High Strength Discontinuously Reinforced Aluminum for Rocket Applications," Affordable Metal Matrix Composites for High Performance Applications. Symposia Proceedings, TMS (The Minerals, Metals & Materials Society), US, No. 2nd, Jan. 1, 2008, pp. 3-12.

Niu, Ben et al. "Influence of addition of 1-15 erbium on microstructure and crystallization behavior of Al-Ni-Y amorphous alloy" Zhongguo Xitu Xuebao, 26(4), pp. 450-454. 2008.

Riddle, Y.W., et al. "Recrystallization Performance of AA7050 Varied with Sc and Zr." Materials Science Forum. 2000. pp. 799-804.

Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.

Hardness Conversion Table. Downloaded from http://www.gordonengland.co.uk/hardness/hardness_conversion_2m.htm, 2002.

SUPERPLASTIC FORMING HIGH STRENGTH $L1_2$ ALUMINUM ALLOYS

BACKGROUND

The present invention relates generally to aluminum alloys and more specifically to a method for forming high strength aluminum alloy powder having $L1_2$ dispersoids therein.

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 owned by the assignee of the present invention discloses aluminum alloys strengthened by dispersed $Al_3X$ $L1_2$ intermetallic phases where X is selected from the group consisting of Sc, Er, Lu, Yb, Tm, and Lu. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). U.S. Patent Application Publication No. 2006/0269437 A1 also commonly owned discloses a high strength aluminum alloy that contains scandium and other elements that is strengthened by $L1_2$ dispersoids.

$L1_2$ strengthened aluminum alloys have high strength and improved fatigue properties compared to commercially available aluminum alloys. Fine grain size results in improved mechanical properties of materials. Hall-Petch strengthening has been known for decades where strength increases as grain size decreases. An optimum grain size for optimum strength is in the nanometer range of about 30 to 100 nm. These alloys also have higher ductility.

SUMMARY

The present invention is a method for consolidating aluminum alloy powders into useful components with superplastic formability at elevated temperatures. In embodiments, powders include an aluminum alloy having coherent $L1_2$ $Al_3X$ dispersoids where X is at least one first element selected from scandium, erbium, thulium, ytterbium, and lutetium, and at least one second element selected from gadolinium, yttrium, zirconium, titanium, hafnium, and niobium. The balance is substantially aluminum containing at least one alloying element selected from silicon, magnesium, manganese, lithium, copper, zinc, and nickel.

The powders are classified by sieving and blended to improve homogeneity. The powders are then vacuum degassed in a container that is then sealed. The sealed container (i.e. can) is vacuum hot pressed to densify the powder charge and then compacted further by blind die compaction or other suitable method. The can is removed and the billet is extruded, forged and/or rolled into useful shapes under superplastic deformation conditions.

DETAILED DESCRIPTION

1. $L1_2$ Aluminum Alloys

Figure 1:
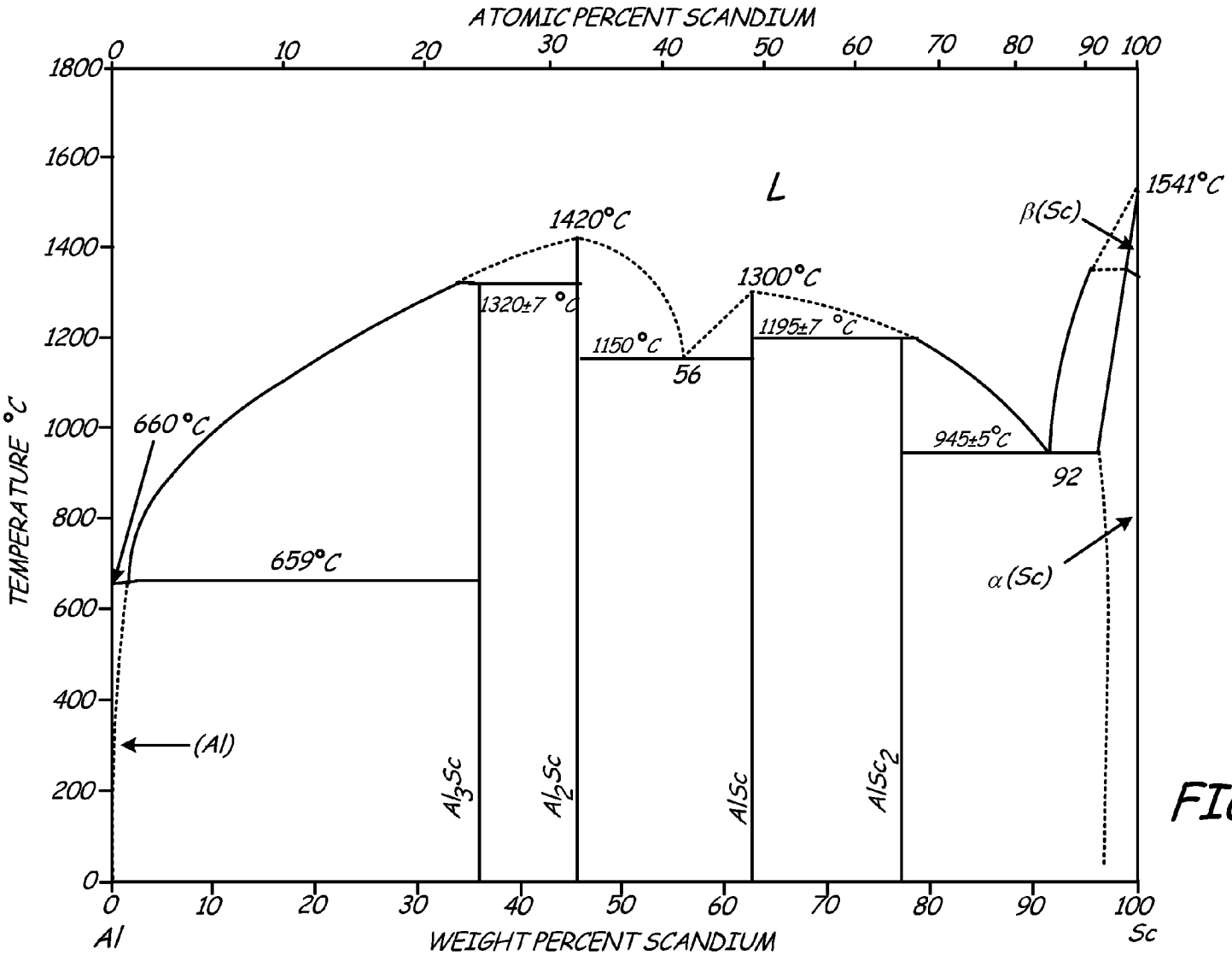
FIG. 1 is an aluminum scandium phase diagram.

Alloy powders of this invention are formed from aluminum based alloys with high strength and fracture toughness for applications at temperatures from about −420° F. (−251° C.) up to about 650° F. (343° C.). The aluminum alloy comprises a solid solution of aluminum and at least one element selected from silicon, magnesium, manganese, lithium, copper, zinc, and nickel strengthened by $L1_2$ $Al_3X$ coherent precipitates where X is at least one first element selected from scandium, erbium, thulium, ytterbium, and lutetium, and at least one second element selected from gadolinium, yttrium, zirconium, titanium, hafnium, and niobium.

The binary aluminum magnesium system is a simple eutectic at 36 weight percent magnesium and 842° F. (450° C.). There is complete solubility of magnesium and aluminum in the rapidly solidified inventive alloys discussed herein.

The binary aluminum silicon system is a simple eutectic at 12.6 weight percent silicon and 1070.6° F. (577° C.). There is complete solubility of silicon and aluminum in the rapidly solidified inventive alloys discussed herein.

The binary aluminum manganese system is a simple eutectic at about 2 weight percent manganese and 1216.4° F. (658° C.). There is complete solubility of manganese and aluminum in the rapidly solidified inventive alloys discussed herein.

The binary aluminum lithium system is a simple eutectic at 8 weight percent lithium and 1105° (596° C.). The equilibrium solubility of 4 weight percent lithium can be extended significantly by rapid solidification techniques. There is complete solubility of lithium in the rapid solidified inventive alloys discussed herein.

The binary aluminum copper system is a simple eutectic at 32 weight percent copper and 1018° F. (548° C.). There is complete solubility of copper in the rapidly solidified inventive alloys discussed herein.

The aluminum zinc binary system is a eutectic alloy system involving a monotectoid reaction and a miscibility gap in the solid state. There is a eutectic reaction at 94 weight percent zinc and 718° F. (381° C.). Zinc has maximum solid solubility of 83.1 weight percent in aluminum at 717.8° F. (381° C.), which can be extended by rapid solidification processes. Decomposition of the supersaturated solid solution of zinc in aluminum gives rise to spherical and ellipsoidal GP zones, which are coherent with the matrix and act to strengthen the alloy.

The aluminum nickel binary system is a simple eutectic at 5.7 weight percent nickel and 1183.8° F. (639.9° C.). There is little solubility of nickel in aluminum. However, the solubility can be extended significantly by utilizing rapid solidification processes. The equilibrium phase in the aluminum nickel eutectic system is $L1_2$ intermetallic $Al_3Ni$.

In the aluminum based alloys disclosed herein, scandium, erbium, thulium, ytterbium, and lutetium are potent strengtheners that have low diffusivity and low solubility in aluminum. All these elements form equilibrium $Al_3X$ intermetallic dispersoids where X is at least one of scandium, erbium, thulium, ytterbium, and lutetium, that have an $L1_2$ structure that is an ordered face centered cubic structure with the X atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Sc$ to coarsening. Additions of zinc, copper, lithium, silicon, manganese, and nickel provide solid solution and precipitation strengthening in the aluminum alloys. These $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Er$ to coarsening. Additions of zinc, copper, lithium, silicon, manganese, and nickel provide solid solution and precipitation strengthening in the aluminum alloys. These $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Tm$ to coarsening. Additions of zinc, copper, lithium, silicon, manganese, and nickel provide solid solution and precipitation strengthening in the aluminum alloys. These $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Yb$ to coarsening. Additions of zinc, copper, lithium, silicon, manganese, and nickel provide solid solution and precipitation strengthening in the aluminum alloys. These $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Lu$ to coarsening. Additions of zinc, copper, lithium, silicon, manganese, and nickel provide solid solution and precipitation strengthening in the aluminum alloys. These $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient, which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids, which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient, which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $D0_{22}$ structure in the equilibrium condition. The metastable $Al_3Ti$ despersoids have a low diffusion coefficient, which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above-mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

$L1_2$ phase strengthened aluminum alloys are important structural materials because of their excellent mechanical properties and the stability of these properties at elevated temperature due to the resistance of the coherent dispersoids in the microstructure to particle coarsening. The mechanical properties are optimized by maintaining a high volume fraction of $L1_2$ dispersoids in the microstructure. The $L1_2$ dispersoid concentration following aging scales as the amount of $L1_2$ phase forming elements in solid solution in the aluminum alloy following quenching. Examples of $L1_2$ phase forming elements include but are not limited to Sc, Er, Th, Yb, and Lu. The concentration of alloying elements in solid solution in alloys cooled from the melt is directly proportional to the cooling rate.

Exemplary aluminum alloys for this invention include, but are not limited to (in weight percent unless otherwise specified):

about Al-M-(0.1-4)Sc-(0.1-20)Gd;
about Al-M-(0.1-20)Er-(0.1-20)Gd;
about Al-M-(0.1-15)Tm-(0.1-20)Gd;
about Al-M-(0.1-25)Yb-(0.1-20)Gd;
about Al-M-(0.1-25)Lu-(0.1-20)Gd;
about Al-M-(0.1-4)Sc-(0.1-20)Y;
about Al-M-(0.1-20)Er-(0.1-20)Y;
about Al-M-(0.1-15)Tm-(0.1-20)Y;
about Al-M-(0.1-25)Yb-(0.1-20)Y;
about Al-M-(0.1-25)Lu-(0.1-20)Y;
about Al-M-(0.1-4)Sc-(0.05-4)Zr;
about Al-M-(0.1-20)Er-(0.05-4)Zr;
about Al-M-(0.1-15)Tm-(0.05-4)Zr;
about Al-M-(0.1-25)Yb-(0.05-4)Zr;
about Al-M-(0.1-25)Lu-(0.05-4)Zr;
about Al-M-(0.1-4)Sc-(0.05-10)Ti;
about Al-M-(0.1-20)Er-(0.05-10)Ti;
about Al-M-(0.1-15)Tm-(0.05-10)Ti;
about Al-M-(0.1-25)Yb-(0.05-10)Ti;
about Al-M-(0.1-25)Lu-(0.05-10)Ti;
about Al-M-(0.1-4)Sc-(0.05-10)Hf;
about Al-M-(0.1-20)Er-(0.05-10)Hf;
about Al-M-(0.1-15)Tm-(0.05-10)Hf;
about Al-M-(0.1-25)Yb-(0.05-10)Hf;
about Al-M-(0.1-25)Lu-(0.05-10)Hf;
about Al-M-(0.1-4)Sc-(0.05-5)Nb;
about Al-M-(0.1-20)Er-(0.05-5)Nb;
about Al-M-(0.1-15)Tm-(0.05-5)Nb;
about Al-M-(0.1-25)Yb-(0.05-5)Nb; and
about Al-M-(0.1-25)Lu-(0.05-5)Nb.

M is at least one of about (4-25) weight percent silicon, (1-8) weight percent magnesium, (0.1-3) weight percent manganese, (0.5-3) weight percent lithium, (0.2-6) weight percent copper, (3-12) weight percent zinc, and (1-12) weight percent nickel.

The amount of silicon present in the fine grain matrix, if any, may vary from about 4 to about 25 weight percent, more preferably from about 5 to about 20 weight percent, and even more preferably from about 6 to about 14 weight percent.

The amount of magnesium present in the fine grain matrix, if any, may vary from about 1 to about 8 weight percent, more preferably from about 3 to about 7.5 weight percent, and even more preferably from about 4 to about 6.5 weight percent.

The amount of manganese present in the fine grain matrix, if any, may vary from about 0.1 to about 3 weight percent, more preferably from about 0.2 to about 2 weight percent, and even more preferably from about 0.3 to about 1 weight percent.

The amount of lithium present in the fine grain matrix, if any, may vary from about 0.5 to about 3 weight percent, more preferably from about 1 to about 2.5 weight percent, and even more preferably from about 1 to about 2 weight percent.

The amount of copper present in the fine grain matrix, if any, may vary from about 0.2 to about 6 weight percent, more preferably from about 0.5 to about 5 weight percent, and even more preferably from about 2 to about 4.5 weight percent.

The amount of zinc present in the fine grain matrix, if any, may vary from about 3 to about 12 weight percent, more preferably from about 4 to about 10 weight percent, and even more preferably from about 5 to about 9 weight percent.

The amount of nickel present in the fine grain matrix, if any, may vary from about 1 to about 12 weight percent, more preferably from about 2 to about 10 weight percent, and even more preferably from about 4 to about 10 weight percent.

The amount of scandium present in the fine grain matrix, if any, may vary from 0.1 to about 4 weight percent, more preferably from about 0.1 to about 3 weight percent, and even more preferably from about 0.2 to about 2.5 weight percent. The Al—Sc phase diagram shown in FIG. 1 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second.

Figure 2:
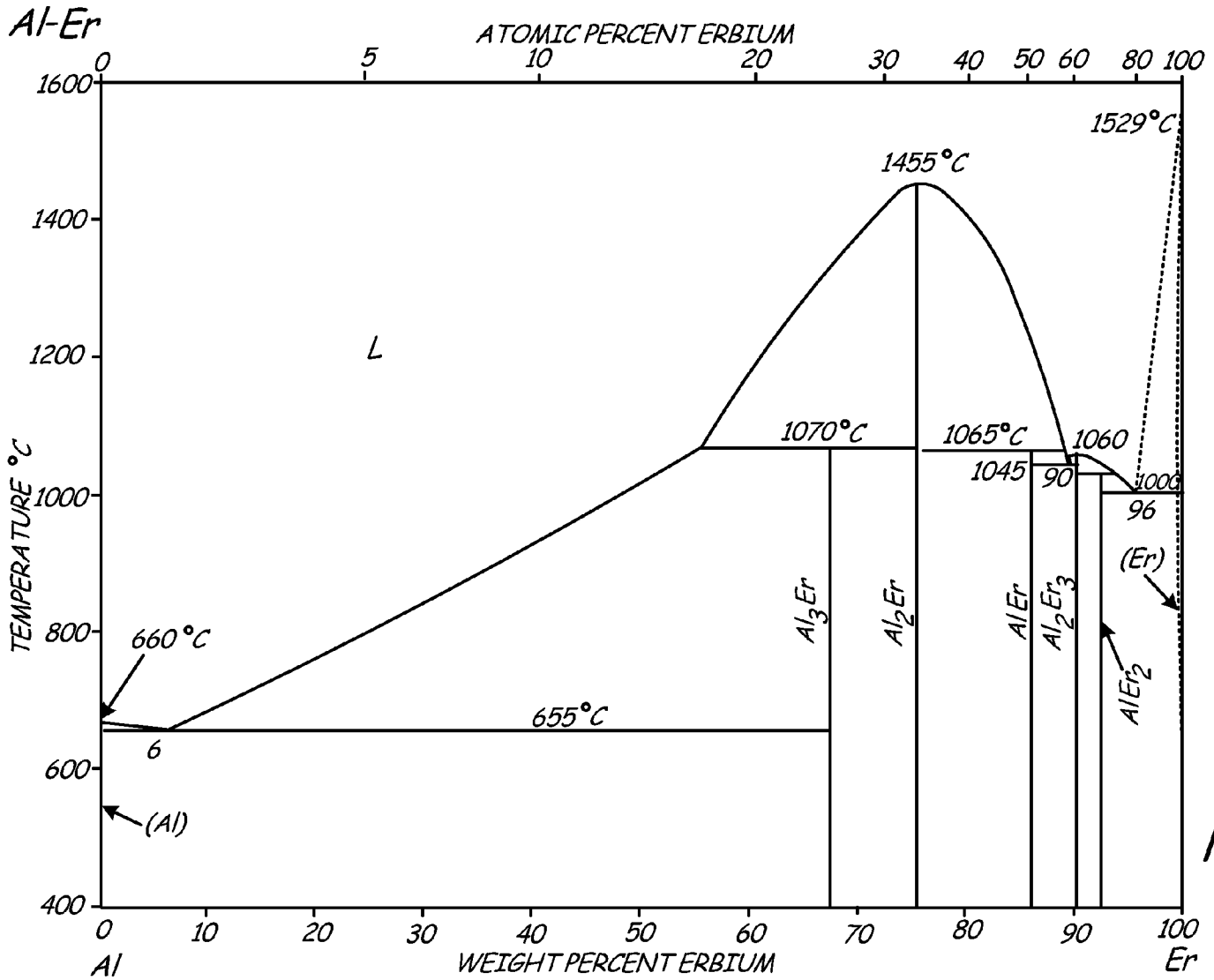
FIG. 2 is an aluminum erbium phase diagram.

The amount of erbium present in the fine grain matrix, if any, may vary from about 0.1 to about 20 weight percent, more preferably from about 0.3 to about 15 weight percent, and even more preferably from about 0.5 to about 10 weight percent. The Al—Er phase diagram shown in FIG. 2 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second.

Figure 3:
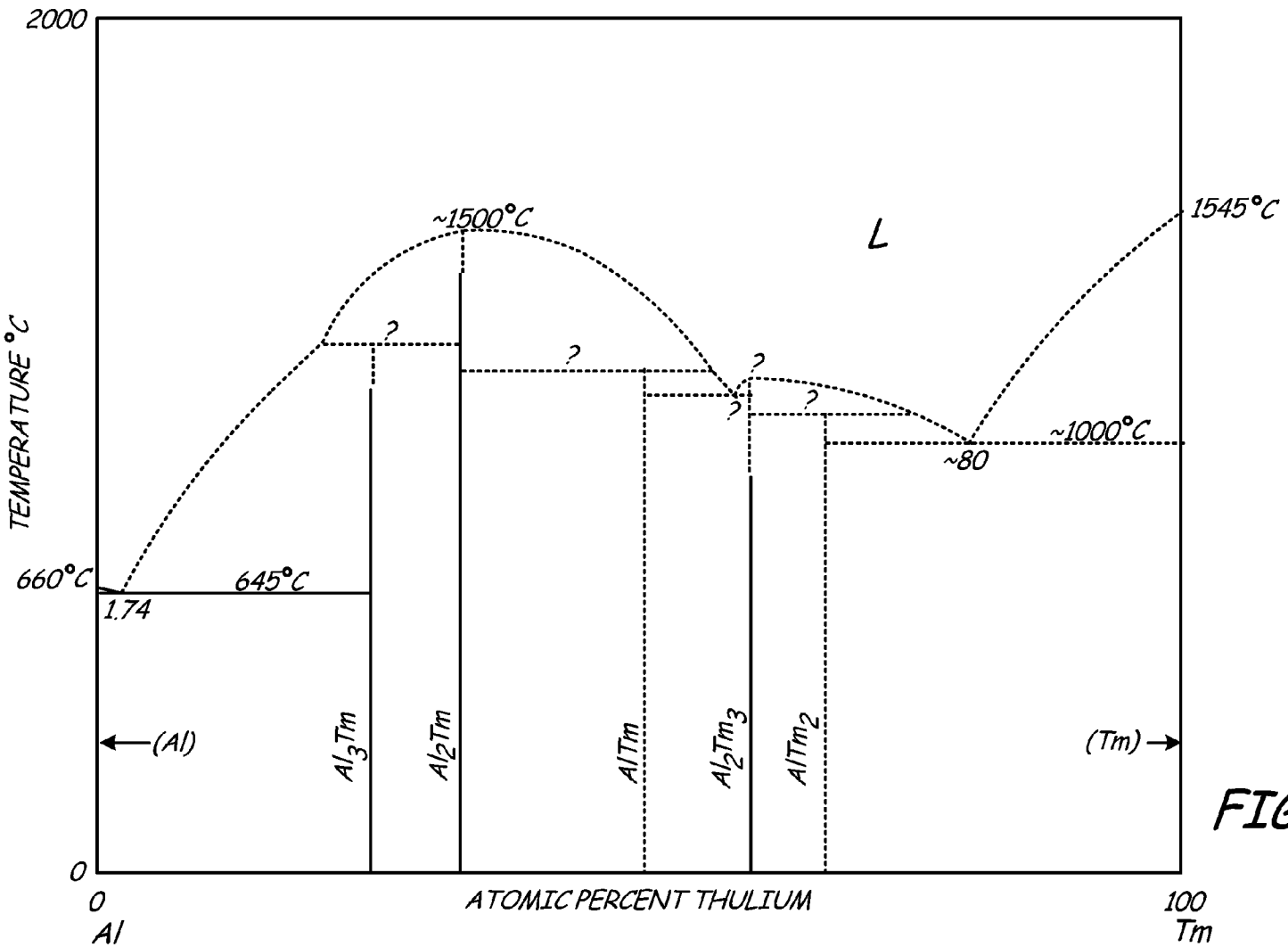
FIG. 3 is an aluminum thulium phase diagram.

The amount of thulium present in the alloys, if any, may vary from about 0.1 to about 15 weight percent, more preferably from about 0.2 to about 10 weight percent, and even more preferably from about 0.4 to about 6 weight percent. The Al—Tm phase diagram shown in FIG. 3 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient, which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 4:
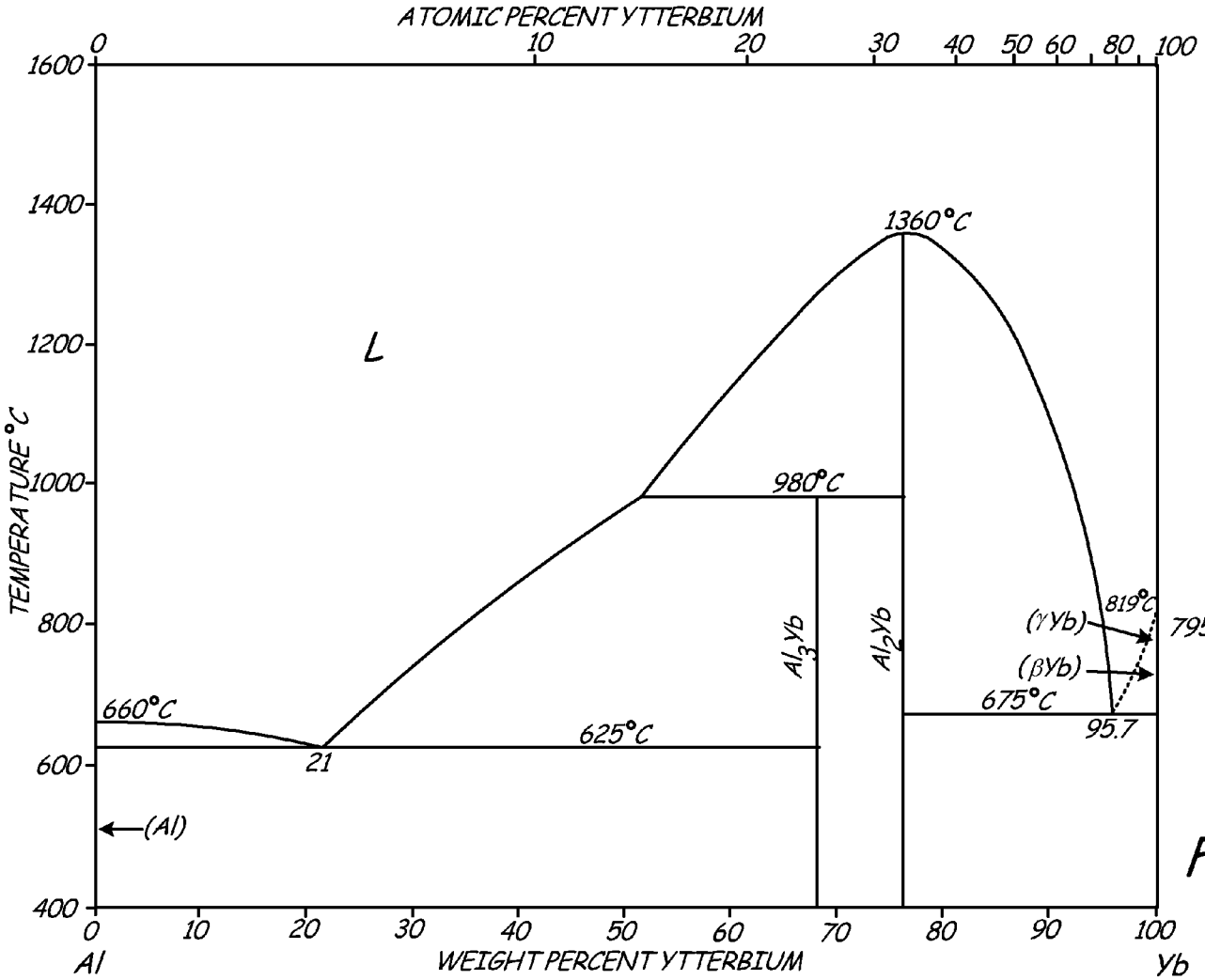
FIG. 4 is an aluminum ytterbium phase diagram.

The amount of ytterbium present in the alloys, if any, may vary from about 0.1 to about 25 weight percent, more preferably from about 0.3 to about 20 weight percent, and even more preferably from about 0.4 to about 10 weight percent. The Al—Yb phase diagram shown in FIG. 4 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C./second.

Figure 5:
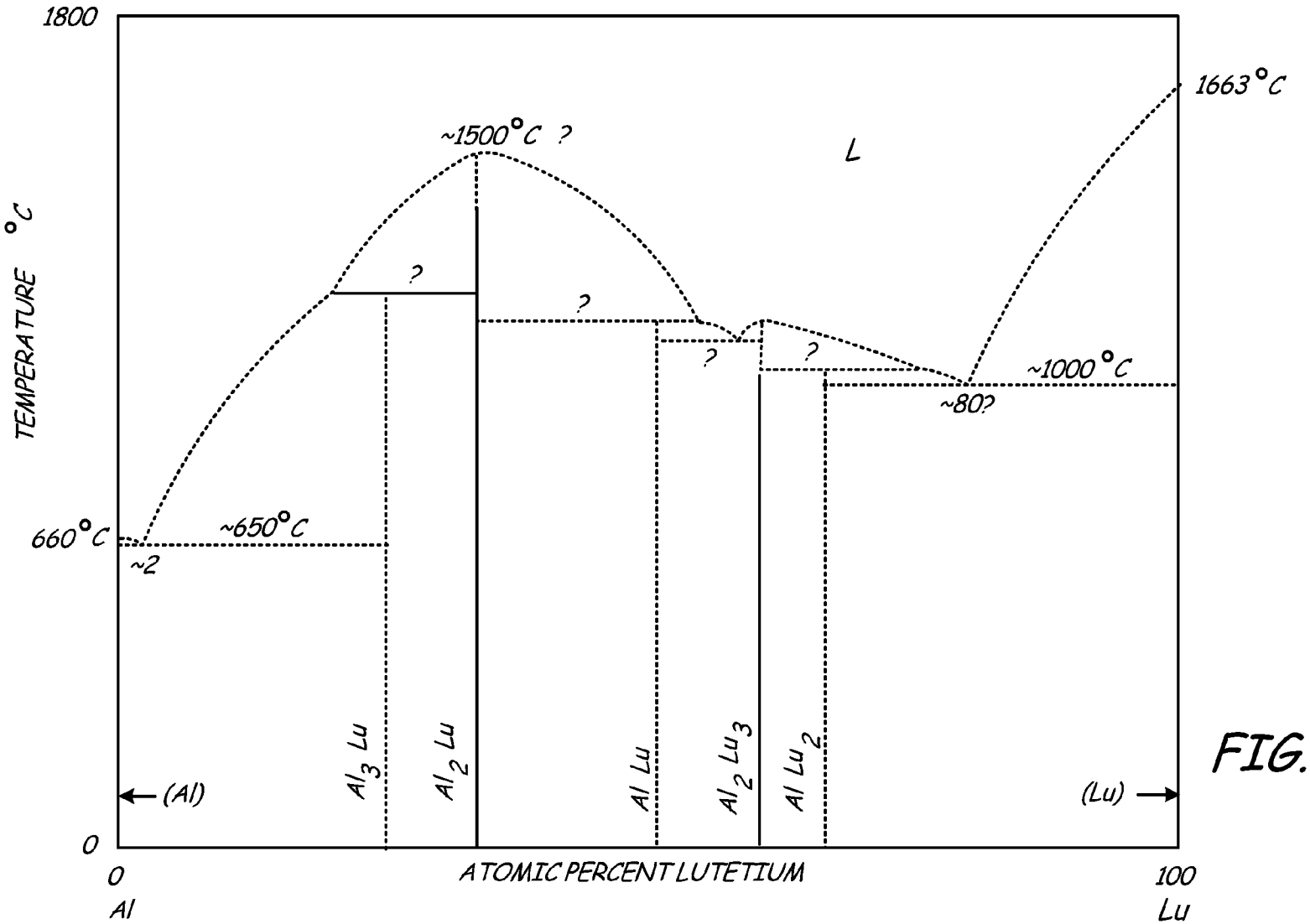
FIG. 5 is an aluminum lutetium phase diagram.

The amount of lutetium present in the alloys, if any, may vary from about 0.1 to about 25 weight percent, more preferably from about 0.3 to about 20 weight percent, and even more preferably from about 0.4 to about 10 weight percent. The Al—Lu phase diagram shown in FIG. 5 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second.

The amount of gadolinium present in the alloys, if any, may vary from about 0.1 to about 20 weight percent, more preferably from about 0.3 to about 15 weight percent, and even more preferably from about 0.5 to about 10 weight percent.

The amount of yttrium present in the alloys, if any, may vary from about 0.1 to about 20 weight percent, more preferably from about 0.3 to about 15 weight percent, and even more preferably from about 0.5 to about 10 weight percent.

The amount of zirconium present in the alloys, if any, may vary from about 0.05 to about 4 weight percent, more preferably from about 0.1 to about 3 weight percent, and even more preferably from about 0.3 to about 2 weight percent.

The amount of titanium present in the alloys, if any, may vary from about 0.05 to about 10 weight percent, more preferably from about 0.2 to about 8 weight percent, and even more preferably from about 0.4 to about 4 weight percent.

The amount of hafnium present in the alloys, if any, may vary from about 0.05 to about 10 weight percent, more preferably from about 0.2 to about 8 weight percent, and even more preferably from about 0.4 to about 5 weight percent.

The amount of niobium present in the alloys, if any, may vary from about 0.05 to about 5 weight percent, more preferably from about 0.1 to about 3 weight percent, and even more preferably from about 0.2 to about 2 weight percent.

In order to have the best properties for the fine grain matrix, it is desirable to limit the amount of other elements. Specific elements that should be reduced or eliminated include no more than about 0.1 weight percent iron, 0.1 weight percent chromium, 0.1 weight percent vanadium, and 0.1 weight percent cobalt. The total quantity of additional elements should not exceed about 1% by weight, including the above listed impurities and other elements.

2. $L1_2$ Alloy Powder Formation and Consolidation

The highest cooling rates observed in commercially viable processes are achieved by gas atomization of molten metals to produce powder. Gas atomization is a two fluid process wherein a stream of molten metal is disintegrated by a high velocity gas stream. The end result is that the particles of molten metal eventually become spherical due to surface tension and finely solidify in powder form. Heat from the liquid droplets is transferred to the atomization gas by convection. The solidification rates, depending on the gas and the surrounding environment, can be very high and can exceed $10^{6}$° C./second. Cooling rates greater than $10^{3}$° C./second are typically specified to ensure supersaturation of alloying elements in gas atomized $L1_2$ aluminum alloy powder in the inventive process described herein.

Figure 6A:
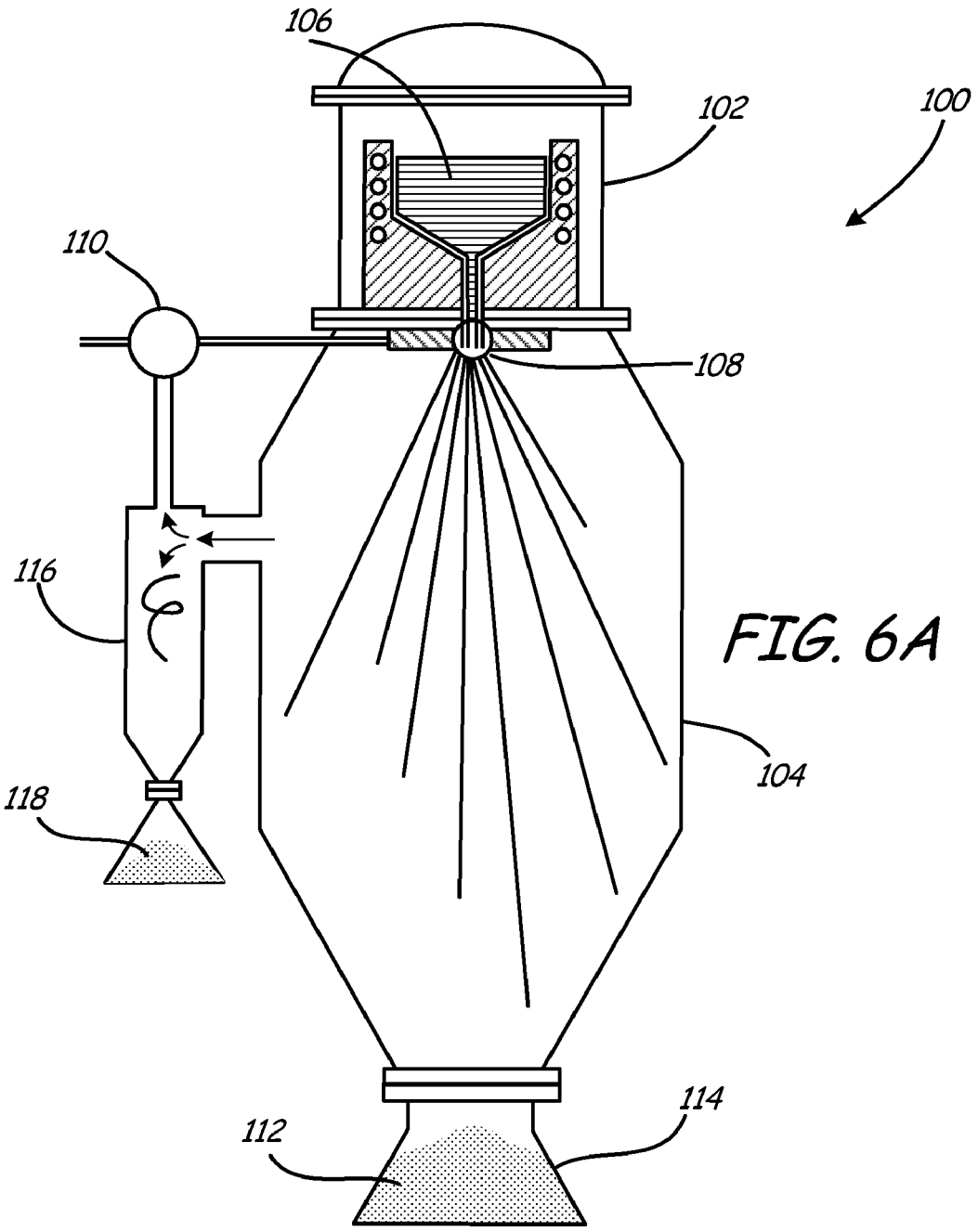
FIG. 6A is a schematic diagram of a vertical gas atomizer.
Figure 6B:
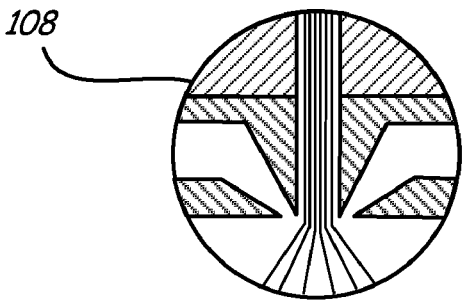
FIG. 6B is a close up view of nozzle 108 in FIG. 6A.

A schematic of typical vertical gas atomizer 100 is shown in FIG. 6A. FIG. 6A is taken from R. Germain, Powder Metallurgy Science Second Edition MPIF (1994) (chapter 3, p. 101) and is included herein for reference. Vacuum or inert gas induction melter 102 is positioned at the top of free flight chamber 104. Vacuum induction melter 102 contains melt 106 which flows by gravity or gas overpressure through nozzle 108. A close up view of nozzle 108 is shown in FIG. 6B. Melt 106 enters nozzle 108 and flows downward till it meets the high pressure gas stream from gas source 110 where it is transformed into a spray of droplets. The droplets eventually become spherical due to surface tension and rapidly solidify into spherical powder 112 which collects in collection chamber 114. The gas recirculates through cyclone collector 116 which collects fine powder 118 before returning to the input gas stream. As can be seen from FIG. 6A, the surroundings to which the melt and eventual powder are exposed are completely controlled.

There are many effective nozzle designs known in the art to produce spherical metal powder. Designs with short gas-to-melt separation distances produce finer powders. Confined nozzle designs where gas meets the molten stream at a short distance just after it leaves the atomization nozzle are preferred for the production of the inventive $L1_2$ aluminum alloy powders disclosed herein. Higher superheat temperatures cause lower melt viscosity and longer cooling times. Both result in smaller spherical particles.

A large number of processing parameters are associated with gas atomization that affect the final product. Examples include melt superheat, gas pressure, metal flow rate, gas type, and gas purity. In gas atomization, the particle size is related to the energy input to the metal. Higher gas pressures, higher superheat temperatures and lower metal flow rates result in smaller particle sizes. Higher gas pressures provide higher gas velocities for a given atomization nozzle design.

To maintain purity, inert gases are used, such as helium, argon, and nitrogen. Helium is preferred for rapid solidification because the high heat transfer coefficient of the gas leads to high quenching rates and high supersaturation of alloying elements.

Figure 7A:
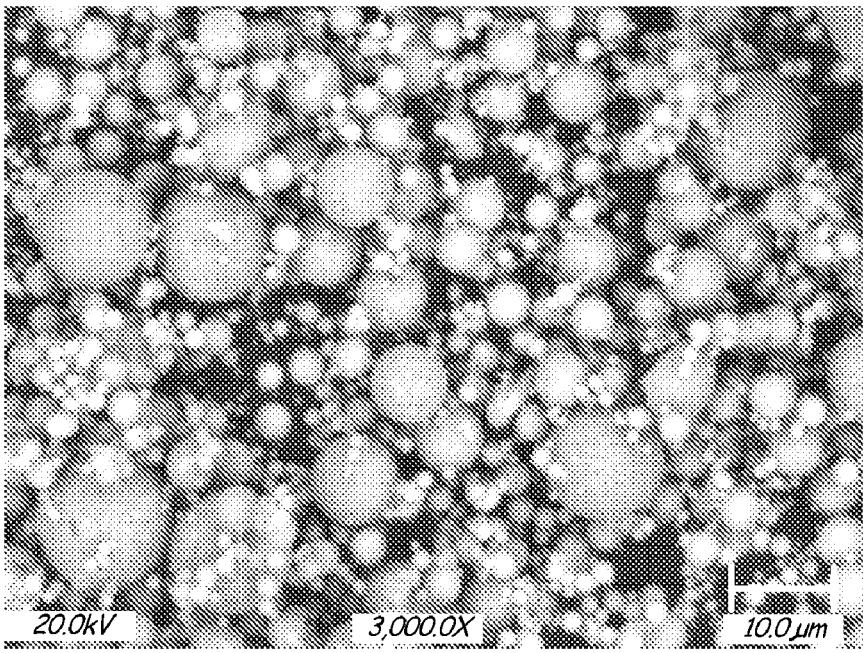
FIGS. 7A and 7B are SEM photos of the inventive aluminum alloy powder.
Figure 7B:
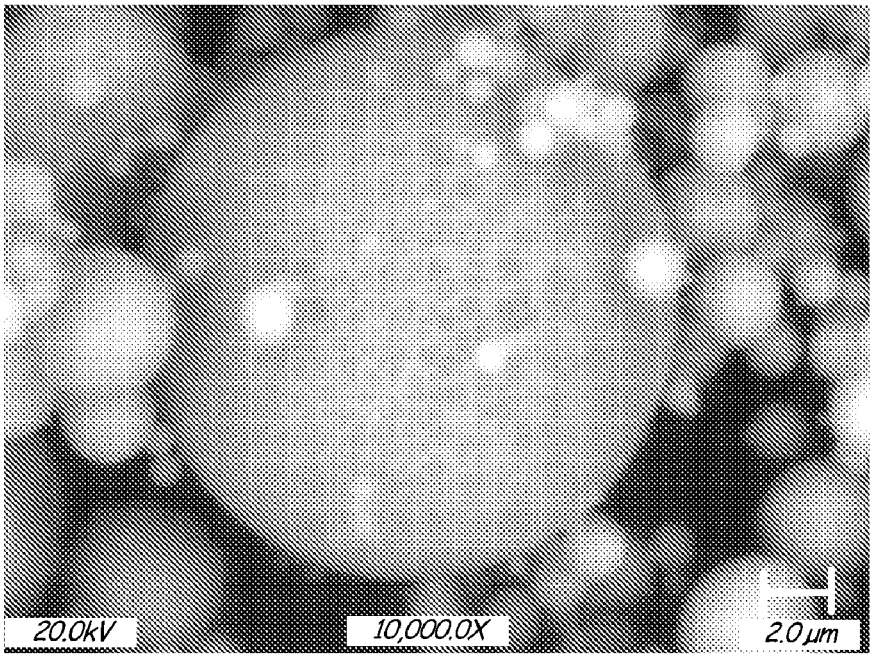
Figure 8A:
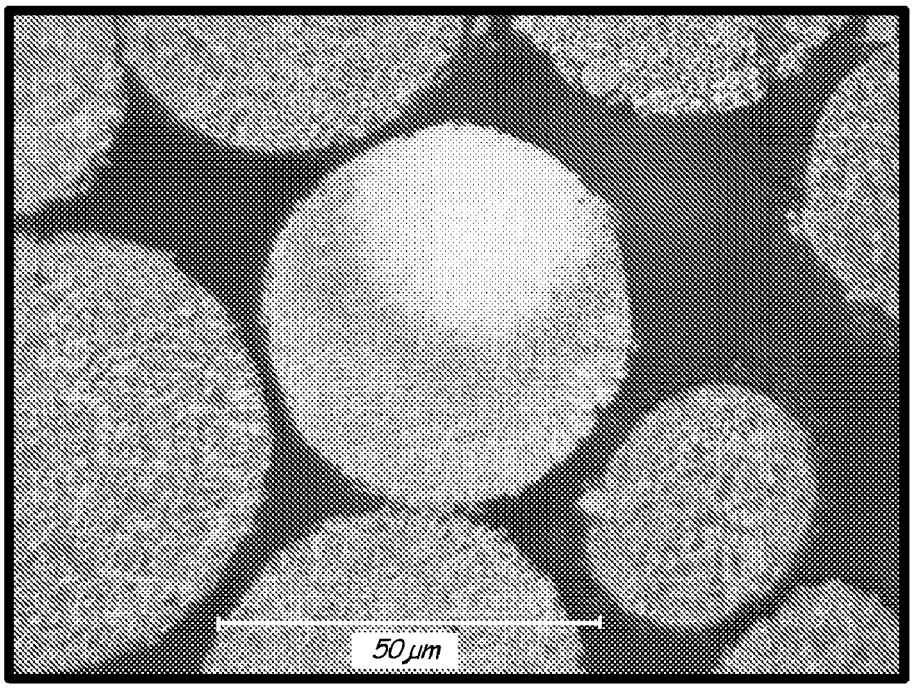
FIGS. 8A and 8B are optical micrographs showing the microstructure of gas atomized $L1_2$ aluminum alloy powder.
Figure 8B:
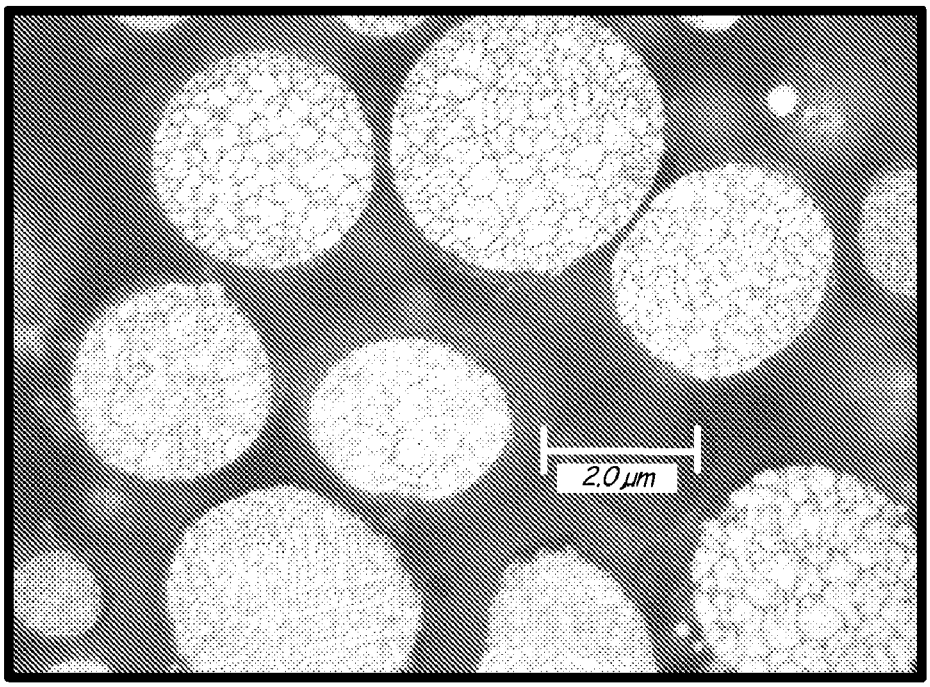

Lower metal flow rates and higher gas flow ratios favor production of finer powders. The particle size of gas atomized melts typically has a log normal distribution. In the turbulent conditions existing at the gas/metal interface during atomization, ultra fine particles can form that may reenter the gas expansion zone. These solidified fine particles can be carried into the flight path of molten larger droplets resulting in agglomeration of small satellite particles on the surfaces of larger particles. An example of small satellite particles attached to inventive spherical $L1_2$ aluminum alloy powder is shown in the scanning electron microscopy (SEM) micrographs of FIGS. 7A and 7B at two magnifications. The spherical shape of gas atomized aluminum powder is evident. The spherical shape of the powder is suggestive of clean powder without excessive oxidation. Higher oxygen in the powder results in irregular powder shape. Spherical powder helps in improving the flowability of powder which results in higher apparent density and tap density of the powder. The satellite particles can be minimized by adjusting processing parameters to reduce or even eliminate turbulence in the gas atomization process. The microstructure of gas atomized aluminum alloy powder is predominantly cellular as shown in the optical micrographs of cross-sections of the inventive alloy in FIGS. 8A and 8B at two magnifications. The rapid cooling rate suppresses dendritic solidification common at slower cooling rates resulting in a finer microstructure with minimum alloy segregation.

Oxygen and hydrogen in the powder can degrade the mechanical properties of the final part. It is preferred to limit the oxygen in the $L1_2$ alloy powder to about 1 ppm to 2000 ppm. Oxygen is intentionally introduced as a component of the helium gas during atomization. An oxide coating on the $L1_2$ aluminum powder is beneficial for two reasons. First, the coating prevents agglomeration by contact sintering and secondly, the coating inhibits the chance of explosion of the powder. A controlled amount of oxygen is important in order to provide good ductility and fracture toughness in the final consolidated material. Hydrogen content in the powder is controlled by ensuring the dew point of the helium gas is low. A dew point of about minus 50° F. (minus 45.5° C.) to minus 100° F. (minus 73.3° C.) is preferred.

In preparation for final processing, the powder is classified according to size by sieving. To prepare the powder for sieving, if the powder has zero percent oxygen content, the powder may be exposed to nitrogen gas which passivates the powder surface and prevents agglomeration. Finer powder sizes result in improved mechanical properties of the end product. While minus 325 mesh (about 45 microns) powder can be used, minus 450 mesh (about 30 microns) powder is a preferred size in order to provide good mechanical properties in the end product. During the atomization process, powder is collected in collection chambers in order to prevent oxidation of the powder. Collection chambers are used at the bottom of atomization chamber 104 as well as at the bottom of cyclone collector 116. The powder is transported and stored in the collection chambers also. Collection chambers are maintained under positive pressure with nitrogen gas which prevents oxidation of the powder.

Figure 9:
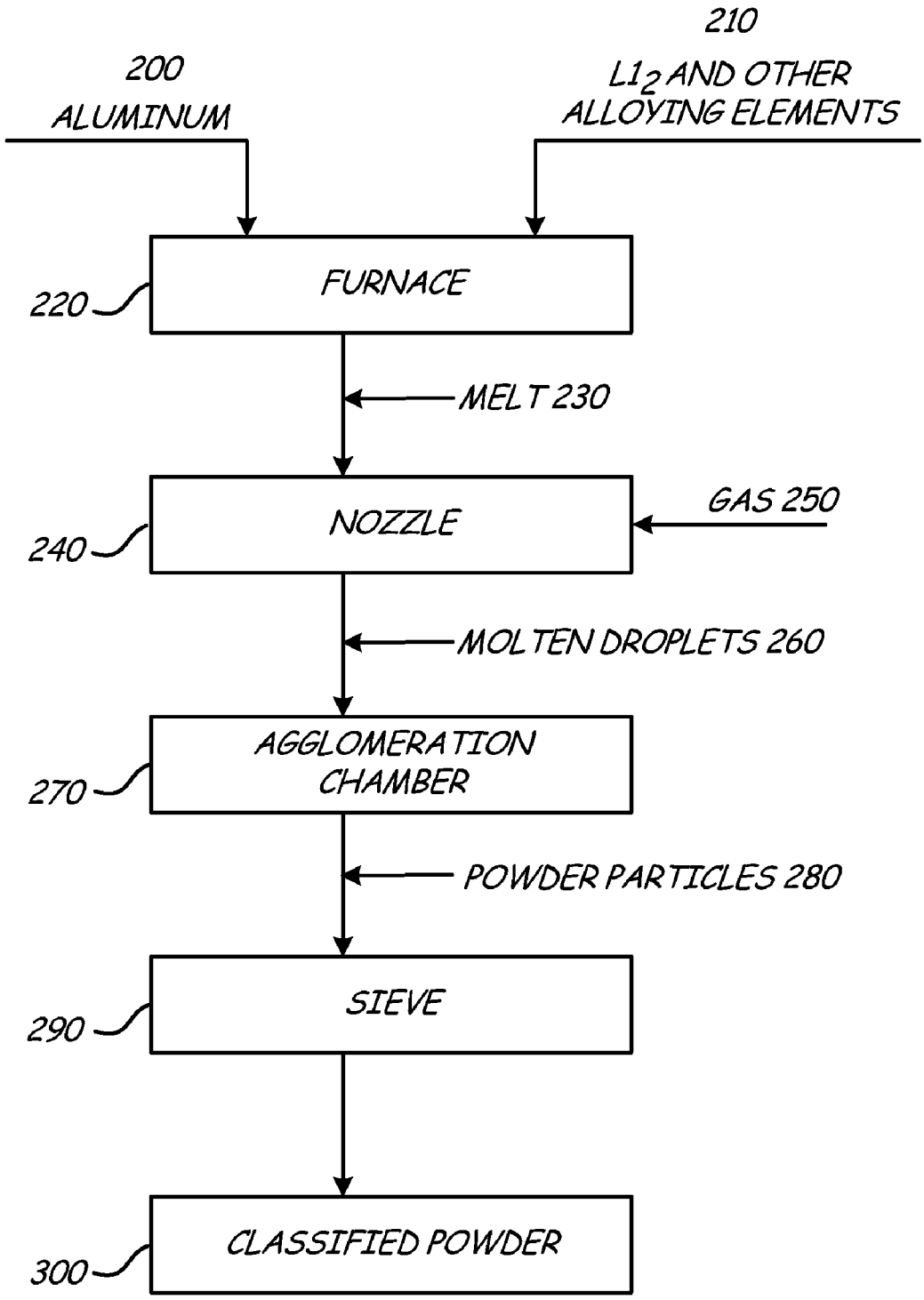
FIG. 9 is a diagram showing the steps of the gas atomization process.

A schematic of the $L1_2$ aluminum powder manufacturing process is shown in FIG. 9. In the process aluminum 200 and L12 forming (and other alloying) elements 210 are melted in furnace 220 to a predetermined superheat temperature under vacuum or inert atmosphere. Preferred charge for furnace 220 is prealloyed aluminum 200 and $L1_2$ and other alloying elements before charging furnace 220. Melt 230 is then passed through nozzle 240 where it is impacted by pressurized gas stream 250. Gas stream 250 is an inert gas such as nitrogen, argon or helium, preferably helium. Melt 230 can flow through nozzle 240 under gravity or under pressure. Gravity flow is preferred for the inventive process disclosed herein. Preferred pressures for pressurized gas stream 250 are about 50 psi (10.35 MPa) to about 750 psi (5.17 MPa) depending on the alloy.

The atomization process creates molten droplets 260 which rapidly solidify as they travel through agglomeration chamber 270 forming spherical powder particles 280. The molten droplets transfer heat to the atomizing gas by convention. The role of the atomizing gas is two fold: one is to disintegrate the molten metal stream into fine droplets by transferring kinetic energy from the gas to the melt stream and the other is to extract heat from the molten droplets to rapidly solidify them into spherical powder. The solidification time and cooling rate vary with droplet size. Larger droplets take longer to solidify and their resulting cooling rate is lower. On the other hand, the atomizing gas will extract heat efficiently from smaller droplets resulting in a higher cooling rate. Finer powder size is therefore preferred as higher cooling rates provide finer microstructures and higher mechanical properties in the end product. Higher cooling rates lead to finer cellular microstructures which are preferred for higher mechanical properties. Finer cellular microstructures result in finer grain sizes in consolidated product. Finer grain size provides higher yield strength of the material through the Hall-Petch strengthening model.

Key process variables for gas atomization include superheat temperature, nozzle diameter, helium content and dew point of the gas, and metal flow rate. Superheat temperatures of from about 150° F. (66° C.) to 200° F. (93° C.) are preferred. Nozzle diameters of about 0.07 in. (1.8 mm) to 0.12 in.

(3.0 mm) are preferred depending on the alloy. The gas stream used herein was a helium nitrogen mixture containing 74 to 87 vol. % helium. The metal flow rate ranged from about 0.8 lb/min (0.36 kg/min) to 4.0 lb/min (1.81 kg/min). The oxygen content of the $L1_2$ aluminum alloy powders was observed to consistently decrease as a run progressed. This is suggested to be the result of the oxygen gettering capability of the aluminum powder in a closed system. The dew point of the gas was controlled to minimize hydrogen content of the powder. Dew points in the gases used in the examples ranged from −10° F. (−23° C.) to −110° F. (−79° C.).

The powder is then classified by sieving process 290 to create classified powder 300. Sieving of powder is performed under an inert environment to minimize oxygen and hydrogen pickup from the environment. While the yield of minus 450 mesh powder is extremely high (95%), there are always larger particle sizes, flakes and ligaments that are removed by the sieving. Sieving also ensures a narrow size distribution and provides a more uniform powder size. Sieving also ensures that flaw sizes cannot be greater than minus 450 mesh which will be required for nondestructive inspection of the final product.

Processing parameters of exemplary gas atomization runs are listed in Table 1.

TABLE 1

Gas atomization parameters used for producing powder

| Run | Nozzle Diameter (in) | He Content (vol. %) | Gas Pressure (psi) | Dew Point (° F.) | Charge Temperature (° F.) | Average Metal Flow Rate (lbs/min) | Oxygen Content (ppm) Start | Oxygen Content (ppm) End |
|---|---|---|---|---|---|---|---|---|
| 1 | 0.10 | 79 | 190 | <−58 | 2200 | 2.8 | 340 | 35 |
| 2 | 0.10 | 83 | 192 | −35 | 1635 | 0.8 | 772 | 27 |
| 3 | 0.09 | 78 | 190 | −10 | 2230 | 1.4 | 297 | <0.01 |
| 4 | 0.09 | 85 | 160 | −38 | 1845 | 2.2 | 22 | 4.1 |
| 5 | 0.10 | 86 | 207 | −88 | 1885 | 3.3 | 286 | 208 |
| 6 | 0.09 | 86 | 207 | −92 | 1915 | 2.6 | 145 | 88 |

The role of powder quality is extremely important to produce material with higher strength and ductility. Powder quality is determined by powder size, shape, size distribution, oxygen content, hydrogen content, and alloy chemistry. Over fifty gas atomization runs were performed to produce the inventive powder with finer powder size, finer size distribution, spherical shape, and lower oxygen and hydrogen contents. Processing parameters of some exemplary gas atomization runs are listed in Table 1. It is suggested that the observed decrease in oxygen content is attributed to oxygen gettering by the powder as the runs progressed.

Inventive $L1_2$ aluminum alloy powder was produced with over 95% yield of minus 450 mesh (30 microns) which includes powder from about 1 micron to about 30 microns. The average powder size was about 10 microns to about 15 microns. As noted above, finer powder size is preferred for higher mechanical properties. Finer powders have finer cellular microstructures. As a result, finer cell sizes lead to finer grain size by fragmentation and coalescence of cells during powder consolidation. Finer grain sizes produce higher yield strength through the Hall-Petch strengthening model where yield strength varies inversely as the square root of the grain size. It is preferred to use powder with an average particle size of 10-15 microns. Powders with a powder size less than 10-15 microns can be more challenging to handle due to the larger surface area of the powder. Powders with sizes larger than 10-15 microns will result in larger cell sizes in the consolidated product which, in turn, will lead to larger grain sizes and lower yield strengths.

Powders with narrow size distributions are preferred. Narrower powder size distributings produce product microstructures with more uniform grain size. Spherical powder was produced to provide higher apparent and tap densities which help in achieving 100% density in the consolidated product. Spherical shape is also an indication of cleaner and lower oxygen content powder. Lower oxygen and lower hydrogen contents are important in producing material with high ductility and fracture toughness. Although it is beneficial to maintain low oxygen and hydrogen content in powder to achieve good mechanical properties, lower oxygen may interfere with sieving due to self sintering. An oxygen content of about 25 ppm to about 500 ppm is preferred to provide good ductility and fracture toughness without any sieving issue. Lower hydrogen is also preferred for improving ductility and fracture toughness. It is preferred to have about 25-200 ppm of hydrogen in atomized powder by controlling the dew point in the atomization chamber. Hydrogen in the powder is further reduced by heating the powder in vacuum. Lower hydrogen in final product is preferred to achieve good ductility and fracture toughness.

Figure 10:
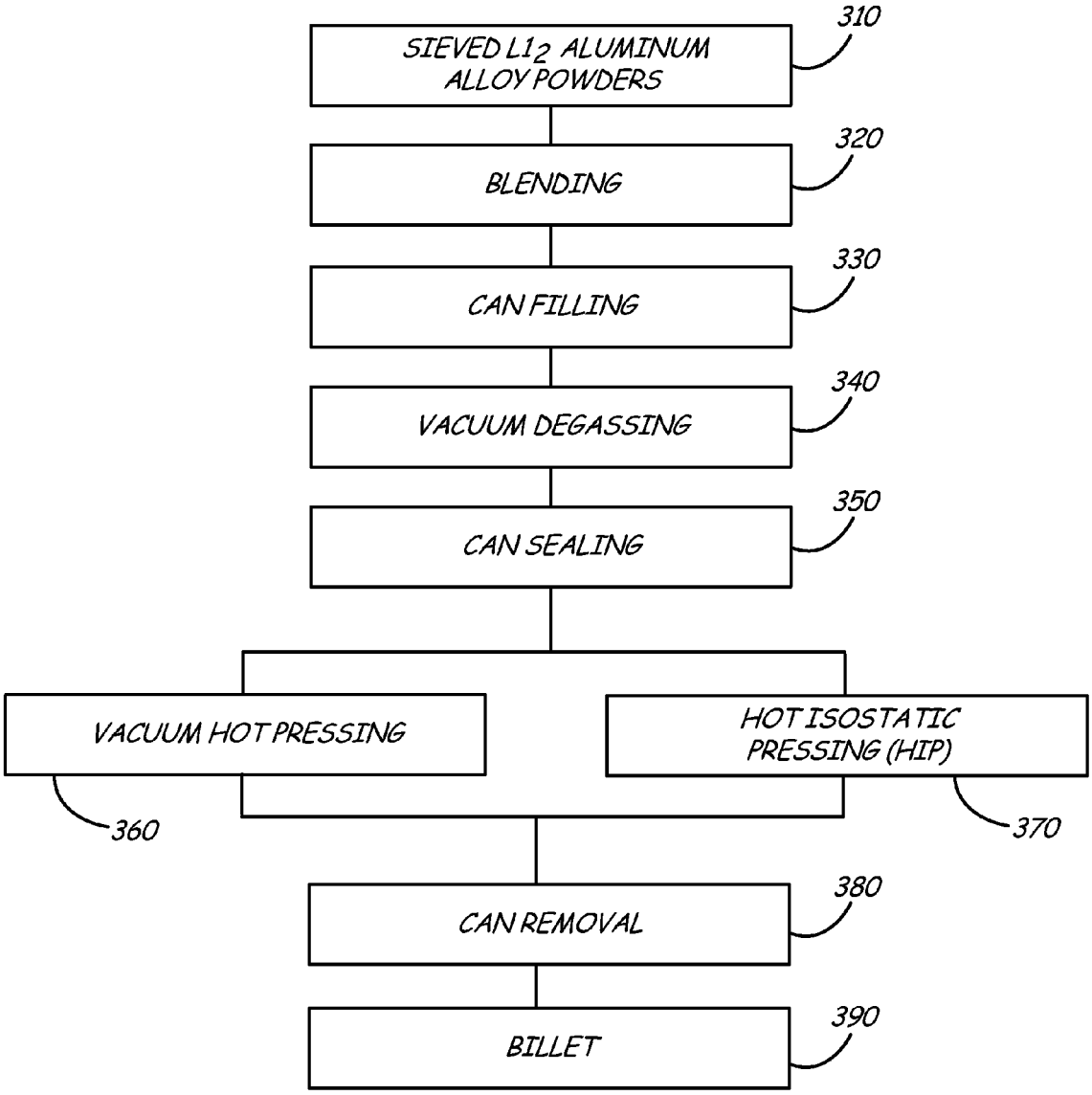
FIG. 10 is a diagram showing the processing steps to consolidate the $L1_2$ aluminum alloy powder.

A schematic of the $L1_2$ aluminum powder consolidation process is shown in FIG. 10. The starting material is sieved and classified $L1_2$ aluminum alloy powders (step 310). Blending (step 320) is a preferred step in the consolidation process because it results in improved uniformity of particle size distribution. Gas atomized $L1_2$ aluminum alloy powder generally exhibits a bimodal particle size distribution and cross blending of separate powder batches tends to homogenize the particle size distribution. Blending (step 320) is also preferred when separate metal and/or ceramic powders are added to the $L1_2$ base powder to form bimodal or trimodal consolidated alloy microstructures.

Following blending (step 320), the powders are transferred to a can (step 330) where the powder is vacuum degassed (step 340) at elevated temperatures. The can (step 330) is an aluminum container having a cylindrical, rectangular or other configuration with a central axis. Vacuum degassing times can range from about 0.5 hours to about 8 days. A temperature range of about 300° F. (149° C.) to about 900° F. (482° C.) is preferred. Dynamic degassing of large amounts of powder is preferred to static degassing. In dynamic degassing, the can is preferably rotated during degassing to expose all of the powder to a uniform temperature. Degassing removes oxygen and hydrogen from the powder.

Following vacuum degassing (step 340), the vacuum line is crimped and welded shut (step 350). The powder is then consolidated further by hot pressing (step 360) or by hot isostatic pressing (HIP) (step 370). At this point the can may be removed by machining (step 380) to form a useful billet (step 390). Following compaction, the billet is forged or rolled into shapes suitable for subsequent superplastic forming.

As discussed below, the present invention discloses that $L1_2$ aluminum alloys exhibit superplastic deformation at elevated temperatures and can be employed in applications requiring this unique deformation phenomenon.

The most usable form of material for superplastic forming is sheet material, therefore, following compaction, the billet is preferably rolled into sheet form. Cross rolling is preferred to minimize directionality in the sheet texture.

Superplastic deformation in metals is defined as the ability to plastically deform by large amounts without experiencing the unstable localized deformation associated with, for instance, necking in an ordinary tensile test. In metal that undergoes superplasticity, the phenomenon occurs at certain temperatures and strain rate ranges. Temperatures on the order of one half the absolute melting point are usually required. For $L1_2$ aluminum alloys, the temperature range and strain rate range are from 500° F. (260° C.) to 1000° F. (537.7° C.) and from $10^{-4}$ to 10 $sec^{-1}$, respectively. Superplastic tensile elongations can range from 200 percent to over 1000 percent without plastic instability. The most probable deformation mechanism for superplasticity in $L1_2$ aluminum alloys is microgram superplasticity. Superplasticity in these alloys is attributed to the existence of a stable microstructure comprising ultra fine grain sizes with sizes ranging from submicron to about 10 microns. During deformations, the microstructure remains stable and undergoes minimal grain growth, such that the deformation mechanism includes continuous recovery and recrystalization accompanied by dislocation glide and climb as well as by subboundary sliding, migration and rotation. In $L1_2$ aluminum alloys, the microstructural stability is attributed to the $L1_2$ dispersoids located at the grain boundaries inhibiting grain growth. The uniqueness of present invention is that superplasticity has been observed for the inventive alloys at significantly lower temperature, 500° F. (260° C.) and at higher strain rates, 10_$sec^{-1}$ compared to previous alloys.

A characteristic of superplastic alloys is that the tensile ductility is a strong function of strain rate increasing with increasing strain rate at a given temperature, reaching a maximum and then decreasing as the strain rate increases further. This behavior is well known to be also related to the rate of change of flow stress with strain rate as measured by $m=d\ln\sigma/d\ln\dot{\epsilon}$ where $\sigma$ is the flow stress and $\dot{\epsilon}$ is the strain rate. M is known as the strain rate sensitivity. When m for a superplastic alloy is plotted against strain rate at a particular temperature, the curve has a peak at a strain rate range where the alloy is superplastic.

Figure 11A:
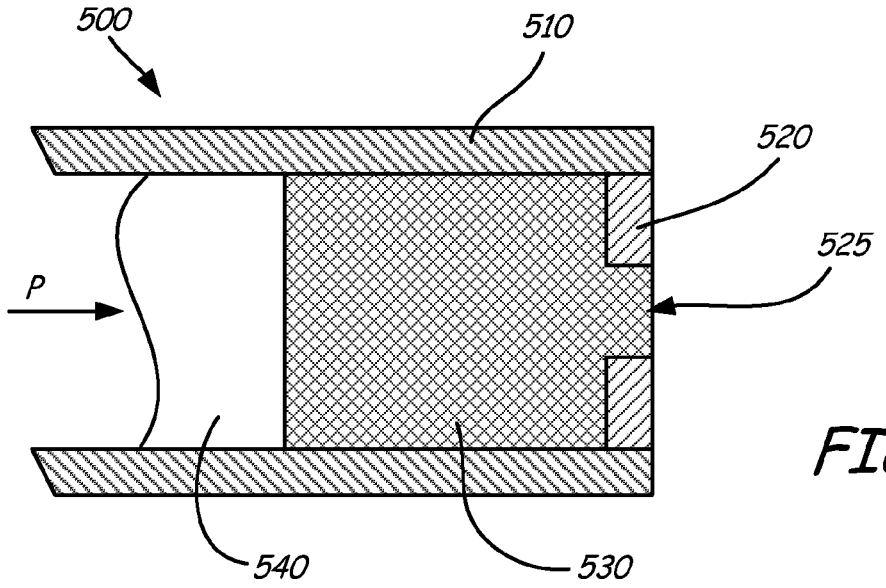
FIGS. 11A and 11B are schematic illustrations of extrusion operation.
Figure 11B:
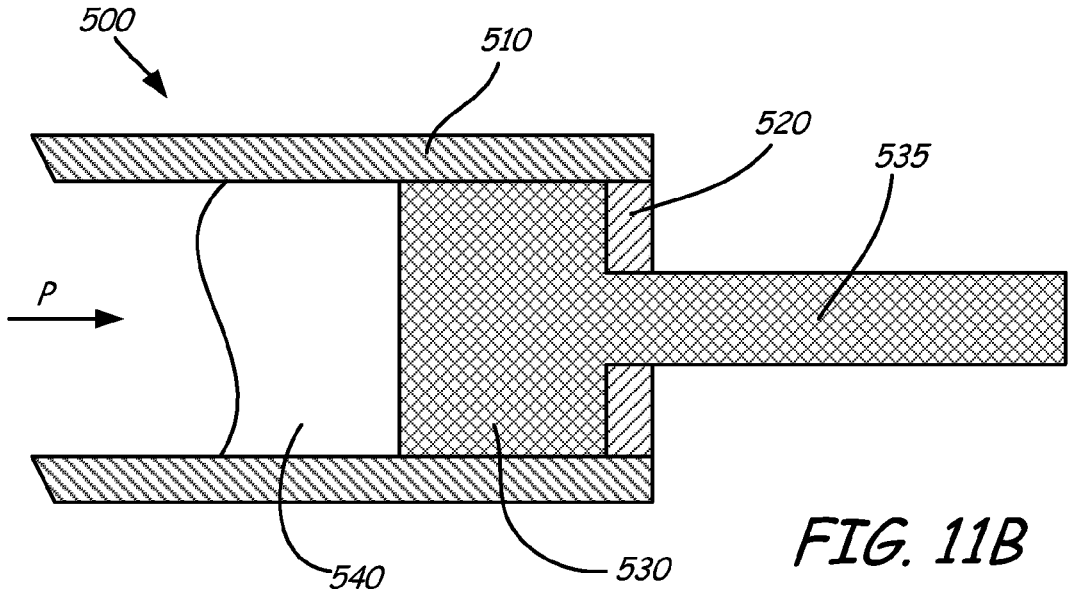

Superplasticity of $L1_2$ aluminum alloys can be utilized to advantage in most forming operations. Major advantages are that forming can take less time and use less energy. Examples are extrusion, rolling, forging, and blow forming. A schematic illustration of an extrusion operation is shown in FIGS. 11A and 11B. FIG. 11A shows extrusion press 500 before extruding billet 530. Extrusion press 500 typically comprises container 510, piston 540, and extrusion die 520. Container 510 is usually cylindrical but may have other cross sections. For elevated temperature operation, extrusion press 500 is in a furnace or is heated by other means. Opening 525 in extrusion die 520 comprises a shape corresponding to the cross sectional shape required for billet 530 after extrusion. FIG. 11B illustrates the extrusion operation wherein pressure P on piston 540 is increased until billet 530 is forced through extrusion die 520 to produce extrusion 535 as shown. Lubricants known to those in the art can be used during extrusion to aid the process by reducing extrusion pressures and improve surface conditions of the extruded billets. Total stress and strain rate during extrusion can be determined from piston velocity and change in cross sectional area of billet 530 before and after extrusion by methods well known in the art.

Figure 12:
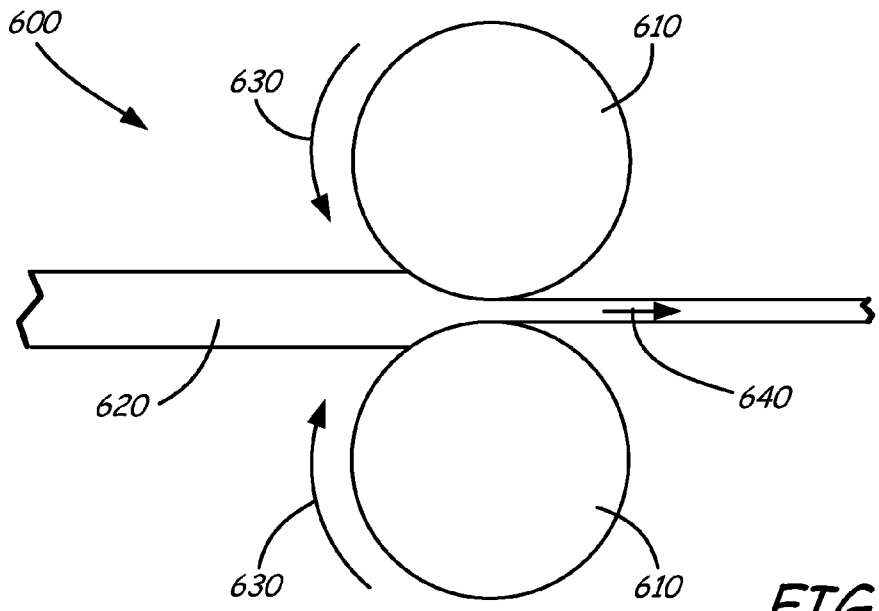
FIG. 12 is a schematic illustration of a rolling operation.

A schematic illustration of rolling operation 600 is shown in FIG. 12. Rolling operation 600 comprises powered rolls 610 and billet 620. Powered rolls 610 rotate in the direction of arrows 630 to draw billet 620 through in the direction of arrow 640. Elevated temperature rolling can be performed using heated rolls and or preheated billets. Lubricants known to those in the art can be used to manage interfacial stresses and surface condition of the billet during rolling. Cross rolling, during which the work piece is rotated 90 degrees before each pass, is routinely used to minimize rolling texture and homogenize microstructure of the rolled billet. Total strain and strain rate during rolling deformation can be determined from roll rotational velocity and billet thickness reduction during a rolling pass by methods well known in the art.

Figure 13A:
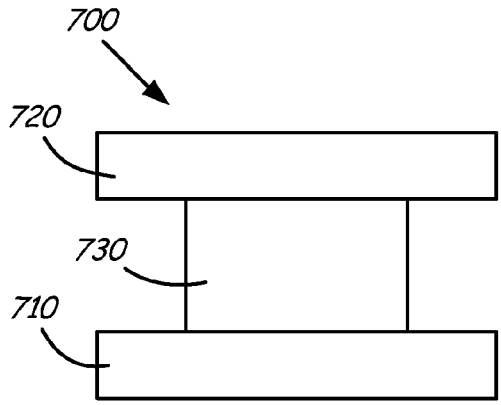
FIGS. 13A and 13B are schematic illustrations of a closed die extrusion operation.
Figure 13B:
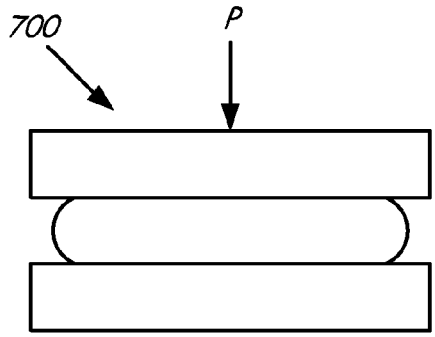

A schematic illustration of an open die forging operation is shown in FIGS. 13A and 13B before and after forging, respectively. FIG. 13A shows open die forging operation 700 comprising base 710, movable upper platen 720, and billet 730. During forging, pressure P is increased on upper platen 720 and billet 730 deforms as shown in FIG. 13B. Base 710, platen 720, and billet 730 can be heated to allow elevated temperature forging. Lubricants known to those in the art can be used during forging to manage interfacial stresses and friction, thereby managing surface condition of the forged billet. Total strain and strain rate during extrusion can be determined from piston velocity and change in cross sectional area of billet 730 before and after forging by methods well known in the art.

Figure 14A:
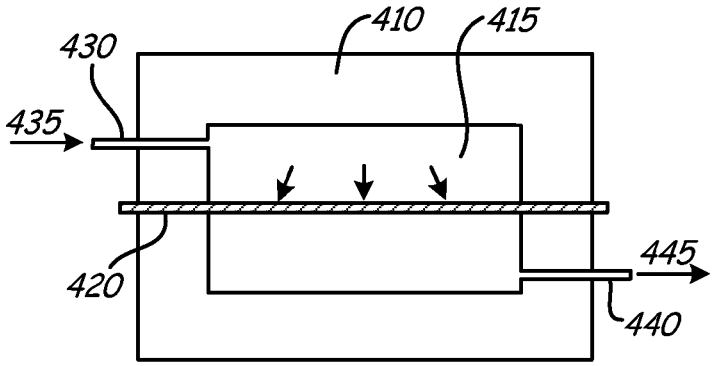
FIGS. 14A to 14D are schematic illustrations of a blow forming operation.

Superplastic forming (SPF) of metal parts can be carried out on bulk or sheet work pieces. Blow forming and vacuum forming will be described as an example of forming superplastic alloy sheets. It is understood that this and the above descriptions are only examples of superplastic forming $L1_2$ aluminum alloys and that many other methods are known in the art to form bulk and sheet $L1_2$ aluminum alloy work pieces by superplastic deformation. FIGS. 14A-14D illustrate blow forming and vacuum forming a superplastic sheet into a part with rectangular geometry such as a pan. The FIGS are taken from Hamilton et al. "Superplastic Sheet Forming", Metals Handbook, $9^{th}$ Ed., Vol. 14, "Forming and Forging" P. 857. FIG. 14A shows superplastic $L1_2$ aluminum alloy sheet 420 fixed in forming chamber 410 with cavity 415. Forming chamber 410 and superplastic $L1_2$ aluminum alloy sheet 420 are maintained at a predetermined forming temperature. For blow forming, a gas, preferably an inert gas, is introduced through inlet 430 while vent 440 is open as indicated by arrow 435. The gas causes the sheet to bulge under the pressure as in FIG. 14B until it contacts the bottom of the chamber in FIG. 14C. Maintaining the gas pressure results in superplastic sheet 420 to completely conform to the die cavity in FIG. 14D. Strain rates during forming are determined by the rate of pressurization.

Figure 14B:
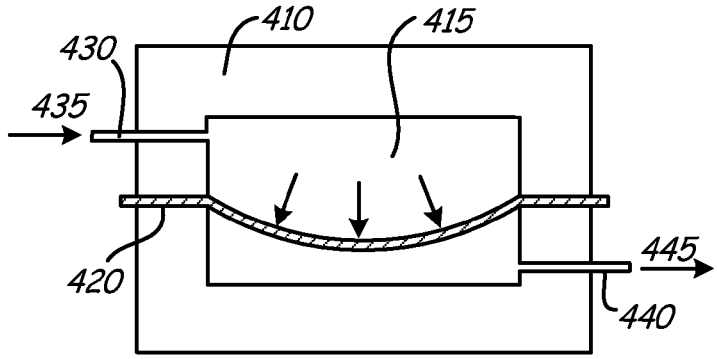
Figure 14C:
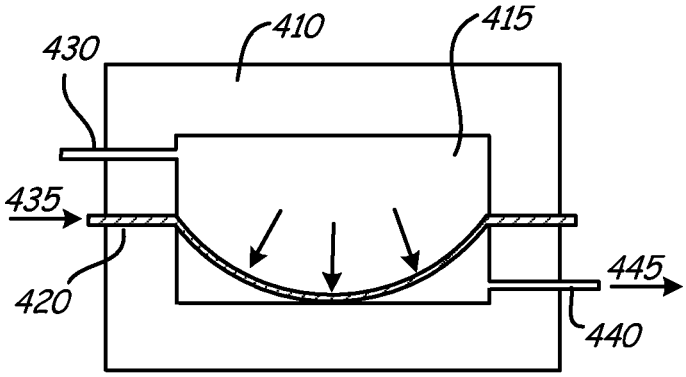
Figure 14D:
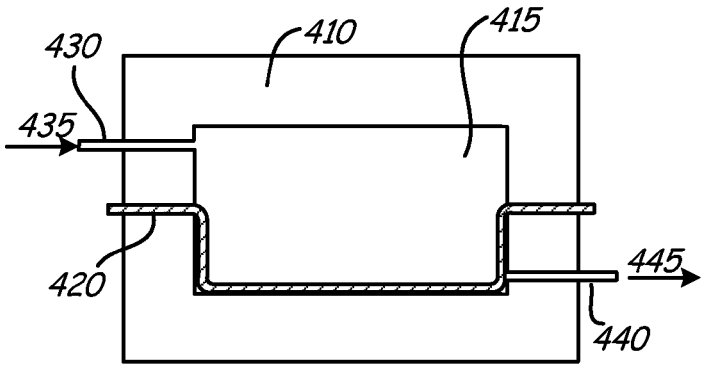

In vacuum forming, chamber 415 is evacuated through vent 440 while inlet 430 is open as indicated by arrow 445, such that the pressure differential between the chambers above and below superplastic sheet 420 causes the sheet to start to bulge as shown in FIG. 14B to contact the edge of chamber 415 as shown in FIG. 14C and finally conform to the shape of the chamber as shown in FIG. 14D.

Following forming the $L1_2$ aluminum alloys can be further given a solution heat treat, quench and age to strengthen the formed part.

Although the present invention has been described with reference to preferred embodiments, workers skilled in the art will recognize that changes may be made in form and detail without departing from the spirit and the scope of the invention.

The invention claimed is:

1. A method for forming a high strength aluminum alloy billet containing $L1_2$ dispersoids, comprising the steps of:

placing in a container a quantity of an aluminum alloy powder containing an $L1_2$ dispersoid $L1_2$ comprising $Al_3X$ dispersoids wherein X is at least one first element selected from the group consisting of:

about 0.1 to about 4.0 weight percent scandium, about 0.1 to about 20.0 weight percent erbium, about 0.1 to about 15.0 weight percent thulium, about 0.1 to about 25.0 weight percent ytterbium, and about 0.1 to about 25.0 weight percent lutetium;

at least one second element selected from the group consisting of about 0.1 to about 20.0 weight percent gadolinium, about 0.1 to about 20.0 weight percent yttrium, about 0.05 to about 4.0 weight percent zirconium, about 0.05 to about 10.0 weight percent titanium, about 0.05 to about 10.0 weight percent hafnium, and about 0.05 to about 5.0 weight percent niobium; and the balance substantially aluminum;

the alloy powder having a mesh size of less than 450 mesh in a container, vacuum degassing the powder at a temperature of about 300° F. (149° C.) to about 900° F. (482° C.) for about 0.5 hours to about 8 days;

sealing the degassed powder in the container under vacuum;

heating the sealed container at about 300° F. (149° C.) to about 900° F. (482° C.) for about 15 minutes to eight hours;

vacuum hot pressing the heated container to form a billet;

removing the container from the formed billet; and superplastically forming the billet into a useful part, wherein superplastic forming is carried out at tensile elongation of from about 200 percent to greater than 1,000 percent without plastic instability.

2. The method of claim 1, wherein the degassing includes rotating the aluminum alloy powder to heat and expose all the powder to vacuum.

3. The method of claim 1, wherein the vacuum hot pressing is carried out at a temperature of from about 600° F. (316° C.) to about 1000° F. (537.7° C.).

4. The method of claim 1, wherein the superplastic forming is carried out at a temperature of from about 500° F. (260° C.) to about 1000° F. (537.7° C.).

5. The method of claim 1, wherein the superplastic forming is carried out at a strain rate of from about $10^4$ $sec^{-1}$ to about 10 $sec^{-1}$.

6. The method of claim 1, wherein the aluminum alloy powder contains at least one third element selected from the group consisting of silicon, magnesium, manganese, lithium, copper, zinc, and nickel.

7. The method of claim 6, wherein the third element comprises at least one of about 4 to about 25 weight percent silicon, about 1 to about 8 weight percent magnesium, about 0.1 to about 3 weight percent manganese, about 0.5 to about 3 weight percent lithium, about 0.2 to about 6 weight percent copper, about 3 to about 12 weight percent zinc, about 1 to about 12 weight percent nickel.

8. The method of claim 1, wherein super-plastically forming the billet comprises forming the billet into a sheet, and blow-forming the sheet at a forming temperature from about 500 degrees Fahrenheit (260 degrees Centigrade) to about 1000 degrees Fahrenheit (537.7 degrees Centigrade) into a forming chamber with a cavity maintained at the forming temperature such that the sheet conforms to the shape of the cavity.

9. The method of claim 1, wherein super-plastically forming the billet comprises forming the billet into a sheet, and vacuum-forming the sheet at a forming temperature of from about 500 degrees Fahrenheit (260 degrees Centigrade) to about 1000 degrees Fahrenheit (537.7 degrees Centigrade) into a forming chamber with a cavity maintained at the forming temperature such that the sheet conforms to the shape of the cavity.

* * * * *

UNITED STATES PATENT AND TRADEMARK OFFICE

CERTIFICATE OF CORRECTION

PATENT NO. : 8,409,496 B2
APPLICATION NO. : 12/558833
DATED : April 2, 2013
INVENTOR(S) : Awadh B. Pandey It is certified that error appears in the above-identified patent and that said Letters Patent is hereby corrected as shown below:

In the Specification

Col. 13, Line 27
Delete "microgram"
Insert --micrograin--

Signed and Sealed this
Fifth Day of November, 2013

Teresa Stanek Rea
*Deputy Director of the United States Patent and Trademark Office*